US007374523B2

(12) United States Patent
Weir et al.

(10) Patent No.: US 7,374,523 B2
(45) Date of Patent: May 20, 2008

(54) TRAINING HARNESS

(75) Inventors: Ross John Weir, Norwich (GB); Michael Peter Caine, Kenilworth (GB)

(73) Assignee: Progressive Sports Technologies, Limited, Loughborough, Leicestershire (GB)

( * ) Notice: Subject to any disclaimer, the term of this patent is extended or adjusted under 35 U.S.C. 154(b) by 172 days.

(21) Appl. No.: 11/055,898

(22) Filed: Feb. 10, 2005

(65) Prior Publication Data

US 2005/0148451 A1 Jul. 7, 2005

(51) Int. Cl.
*A63B 23/00* (2006.01)

(52) U.S. Cl. ..... 482/148

(58) Field of Classification Search ..... 482/124, 482/148, 43; D29/101.1; 244/151 R; D30/134
See application file for complete search history.

(56) References Cited

U.S. PATENT DOCUMENTS 4,910,802 A 3/1990 Malloy
4,913,135 A * 4/1990 Mattingly ..... 602/18
5,570,472 A * 11/1996 Dicker ..... 2/69
6,047,406 A 4/2000 Wilkinson
6,176,816 B1 1/2001 Wilkinson
6,645,093 B2 * 11/2003 Sheppard ..... 473/450

* cited by examiner

*Primary Examiner*—Lori Amerson
(74) *Attorney, Agent, or Firm*—Renner, Kenner, Greive, Bobak, Taylor & Weber

(57) ABSTRACT

A training harness (11) for exercising the inspiratory muscles of an athlete (10) is adapted to embrace the thorax (12) of the athlete (10) during the performance of aerobic exercise. The harness (11) has a back plate (13), a chest plate (14) and linkages (15-24) interconnecting said plates (13,14) by extending around the thorax (12) of the athlete (10). The linkages (15-24) define a pre-determined circumference of the harness (11), which may be increased when the athlete's thorax (12) expands upon inspiration—however such an increase in the circumference of the harness (11) requires the athlete (10) to work against an applied resistive load.

20 Claims, 3 Drawing Sheets

TRAINING HARNESS

This invention relates to a training harness for exercising an athlete's inspiratory muscles during the performance of aerobic exercise. In certain preferred embodiments, the invention also relates to a garment incorporating or acting as such a harness.

The inspiratory muscles are used during normal respiration to expand the thorax (chest) when air is inhaled, thus allowing the lungs to increase in volume. Restricting or resisting the expansion of the thorax causes the inspiratory muscles to work harder to achieve the same intake of air into the lungs. The effects on pulmonary (lung) function of restricting thorax expansion have been studied, for example by Coast et al. in Respiration, 1999, 66, pp.183-194, which provides a reliable method for measuring the oxygen cost associated with varying levels of thorax restriction, as might be observed in certain pulmonary diseases, or imposed by occupational requirements such as the wearing of bullet-proof vests.

It has for some time been thought desirable to utilise these studies in the field of sports training—the theory being that by applying resistance to the expansion of an athlete's thorax during the performance of aerobic exercise, his or her inspiratory muscles will be made to work harder. Repetition of such resisted exercise on a regular basis will therefore increase the strength and stamina of the inspiratory muscles, thus enabling the athlete to take in more air during normal, un-resisted exercise—and thus enhance his or her performance.

At this point it should be emphasised that the present invention is concerned with resisting thoracic expansion, rather than restricting it. That is to say, the training harness of the present invention allows an athlete to expand his or her thorax to its normal inflated volume—but any such expansion requires additional work to be done by the inspiratory muscles against an applied resistive load.

Previous devices for training the inspiratory muscles have focussed on providing resistance to the athlete's intake of air via a mouthpiece incorporating means for inhibiting the flow of air therethrough, rather than by resisting thoracic expansion. Such devices have limited applicability to serious sports training, as they do not enable the athlete to develop his or her inspiratory muscles whilst carrying out aerobic exercise specific to their sport, but instead require sessions dedicated to the exercise of the inspiratory muscles alone. Furthermore, such mouthpiece—based training devices tend to be rather unappealing to the user, and also require regular sterilisation.

The present invention seeks to provide a device which by resisting thoracic expansion will enable athletes to exercise their inspiratory muscles whilst simultaneously performing normal aerobic exercise.

According to the present invention, there is provided a training harness for exercising an athlete's inspiratory muscles, said harness being adapted to embrace the athlete's thorax during the performance of aerobic exercise, and comprising a chest plate, a back plate, and linkages interconnecting said plates on each side of the thorax, normally to define a pre-determined circumference of said harness, but upon expansion of the athlete's thorax to permit an increase in said circumference against an applied resistive load.

In a first embodiment of training harness according to the present invention, the chest plate is relatively inflexible, whilst the linkages are elastically-expandable.

The elastically-expandable linkages could be of diverse kinds, but for simplicity and thus robustness of construction it is presently preferred that they should comprise a plurality of resiliently-flexible ribs extending forwardly from the back plate, at least part-way around each side of the athlete's thorax. The ribs are thus arranged in alignment with the direction in which the athlete's own muscle fibre extends.

In order that the resistance provided by the harness shall be spread equally across either side of the athlete's thorax, it is preferred that the ribs should be arranged in opposed pairs, one to each side of the thorax. The respective members of each such pair are arranged symmetrically on opposite sides of the thorax, and are interconnected to one another by attachment to opposite ends of a cord. Each member of such a pair is thus made to expand and contract in conjunction with the other member of said pair.

The training harness will preferably comprise at least three or more pairs of opposed ribs, and it is at present thought best to provide five pairs of opposed ribs. Whilst the majority of the pairs of ribs are adapted to extend around the sides of the athlete's thorax so as to exercise his or her intercostal muscles, at least one pair of ribs should be adapted to extend over the athlete's shoulders. This serves both to retain the harness in position against gravity and also to exercise the athlete's sterno-clavicular muscles, which form part of the respiratory muscle group.

The harness may be constructed from any suitable light-weight yet robust material, such as rubber. Preferably however, at least the chest and back plates should be formed of a moulded silicone resin material.

As stated above, each rib preferably has a substantially inextensible cord associated therewith, that interlinks the "free" end distal from the back plate of the flexible rib on one side with the free end of a rib on the other side. The cord will advantageously then pass through one of a plurality of apertures in the chest plate. While the cord itself is inextensible, clearly by varying the length of cord passing through the aperture, the athlete can adjust the normal circumference of the harness. As the thorax seeks to expand further, beyond-normal enlargement of the circumference can then be achieved only by deformation of the resiliently-flexible ribs which are interconnected by the cord, and thus against the bias thereby imparted to the cord. The degree of resistance to thorax expansion provided by the harness during aerobic exercise can thus be controlled.

This may be achieved by the provision of control means located on the chest plate. The control means may also be used to vary the normal circumference of the harness, so as to accommodate different sizes of athlete. Preferably the control means will comprise a reel for winding-in and winding-out the cord, and a dial in communication therewith, such that rotation of the dial in one direction increases the tension in the ribs and rotation in the other direction decreases the tension.

Most preferably, the reel comprises a ratcheted drum, so as to enable the elastic ribs to be set at a pre-determined initial tension. This is important, as it allows the athlete to select a tension or "load" appropriate to a specific exercise or training objective. For example, a high load may be selected for short-duration strength training, whereas a lower load may be selected for longer-duration endurance training.

The ratcheted drum preferably further comprises a quick-release mechanism, which may desirably be operated by a push-button. The quick-release mechanism disengages the ratchet, thus enabling the cords to be rapidly unwound such that the elastic ribs return to an unstretched condition.

In addition to setting the elastic ribs to a pre-determined initial tension (and therefore determining the initial resistive load applied to the thorax), it is also much preferred that the applied load is capable of being varied during an athlete's inspiration. In particular, it is desirable that the applied load should be decreased during an athlete's inspiration, and that the rate of that decrease, or "decay", should be controllable.

Therefore, the control means is preferably provided with a cam incorporated into the reel or ratchet mechanism. Upon inspiration, the cords are permitted to unwind from the reel in a controlled manner, and at a rate determined by the shape of the cam.

This controlled unwinding results in the resistive load applied to the thorax being reduced in a predictable and controllable manner during inspiration. The rate of unwinding, and thus the decay of the applied load, can be manipulated by changing the shape of the cam. The duration of unwinding can also be altered so as to enable the load decay to be achieved over a variable period. This is desirable if the user wishes the load to decay slowly, for example when inspiring fully but with a low breathing frequency, or indeed if the user wishes the load to decay quickly, for example when inspiring partially with a high breathing frequency. The user may thus select a load decay profile appropriate to his exercise regime and training objectives.

The cam system preferably includes a return mechanism, such as a spring and/or a ratcheted drum, by means of which the system is re-set ready for the next inspiration.

The training harness according to the present invention, as thus far described, is suitable for exercising an athlete's inspiratory muscles by providing resistance to expansion of the thorax. However, respiration is of course a two-stage cycle comprising inspiration (during which the thorax expands) and expiration (during which the thorax contracts). Different muscle groups, or at least different functions of the same muscle groups are utilised in these different stages.

The present invention is not concerned with the provision of a training system for exercising the expiratory muscles by providing resistance thereto. Nevertheless, it is desirable that the inspiratory muscle training system of the present invention should not actually provide assistance to the expiratory muscles, as can occur if the elastic elements are allowed freely to relax back to an unstretched condition following inspiration.

Therefore, an alternative embodiment of training harness according to the present invention, is also provided, in which the load applied to the athlete's thorax is a frictional resistive load, rather than an elastic resistive load.

In this alternative embodiment, the control means is further provided with a first fixed disc and a second rotatable disc, said first and second discs being mounted co-axially, and arranged such that a face of said second disc bears against an opposed face of said first disc. The second disc is connected via one or more substantially inextensible cords to the harness, which is itself required to be substantially inelastic in this embodiment.

On inspiration, the second disc is caused to rotate relative to the first, work being required to overcome the frictional resistance between the opposed disc faces. The second disc is preferably mounted for rotation in one direction only, such that upon expiration, no rotation occurs. A return mechanism, preferably comprising a low-tension spring, re-sets the system by allowing the harness to contract freely to its initial circumference. The athlete's expiratory muscles are therefore neither assisted nor resisted, but allowed to work freely.

In order that the resistive load exerted on the athlete by the harness may be spread as evenly as practicable over his or her musculature, it is much preferred that the training harness should be provided together with a garment formed from a so-called compression material. The garment may either be formed integrally with the training harness or supplied as a separate component. Such compression materials, such as that sold under the Registered Trade Mark Lycra®, are widely used by athletes in training closely to embrace the musculature, and thereby to spread any applied load more evenly thereacross.

In a further alternative embodiment of training harness according to the present invention, the above-described garment is itself adapted to act as the training harness.

In this embodiment, the elastic resistive load applied to the athlete, is controlled by manipulating the properties of the materials used, the orientation of the fibres, and the ratio of the different materials used. For example, when using materials which exhibit elastic properties, the load applied to the athlete's thorax will increase upon expansion of the thorax (i.e. upon inspiration).

The initial load, and the rate of increase of the load can be determined by the sizing of the garment, the "length-tension relationship" of the materials used, and the orientation of the fibres. Materials with relatively flat length-tension properties, such as those exhibited by certain types of Lycra®, will exhibit little increase in tension as the thorax expands. Furthermore, materials with inverse length-tension properties, which exhibit a reduction in tension upon lengthening, could be used to enable a decaying load profile as described previously with reference to the first embodiment.

The orientation of the fibres within different panels of the garment could also be manipulated such that the degree of tension, and therefore the resistive load applied by the various fabrics, could be altered depending on the degree and direction of movement of the panel during thoracic expansion. In this way, fabrics giving different applied load characteristics in different planes could be placed strategically within the garment according to the manner in which the thorax expands. Fibre orientation within the garment is particularly desirable as it could be used to engender good "form" within the user, i.e. to promote a desirable breathing pattern.

In order that the present invention may be better understood, preferred embodiments thereof will now be described, though only by way of illustration, with reference to the accompanying drawings, in which.

Figure 1:
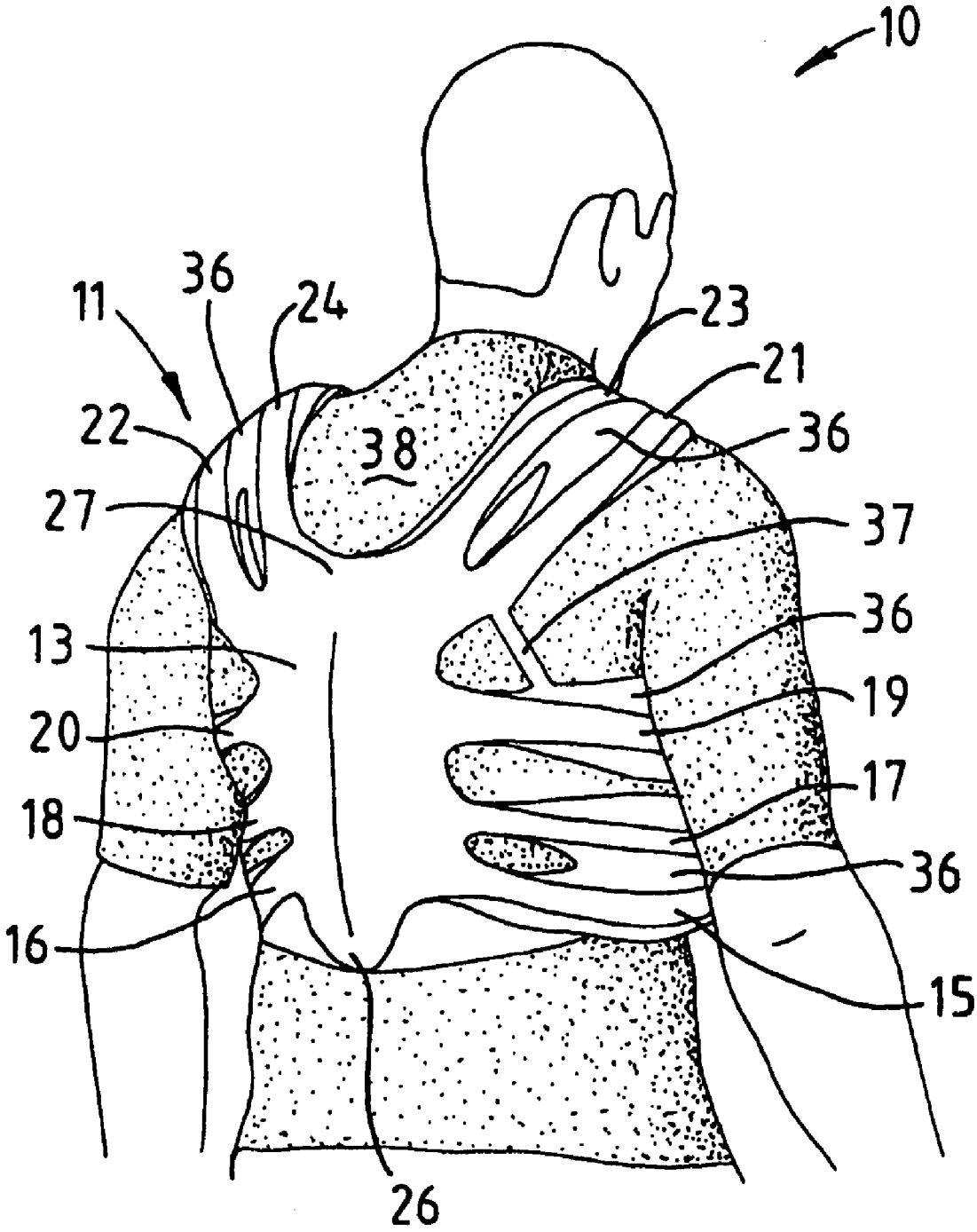
FIG. 1 shows a back view of an athlete wearing a training harness according to a first embodiment of the present invention.
Figure 2:
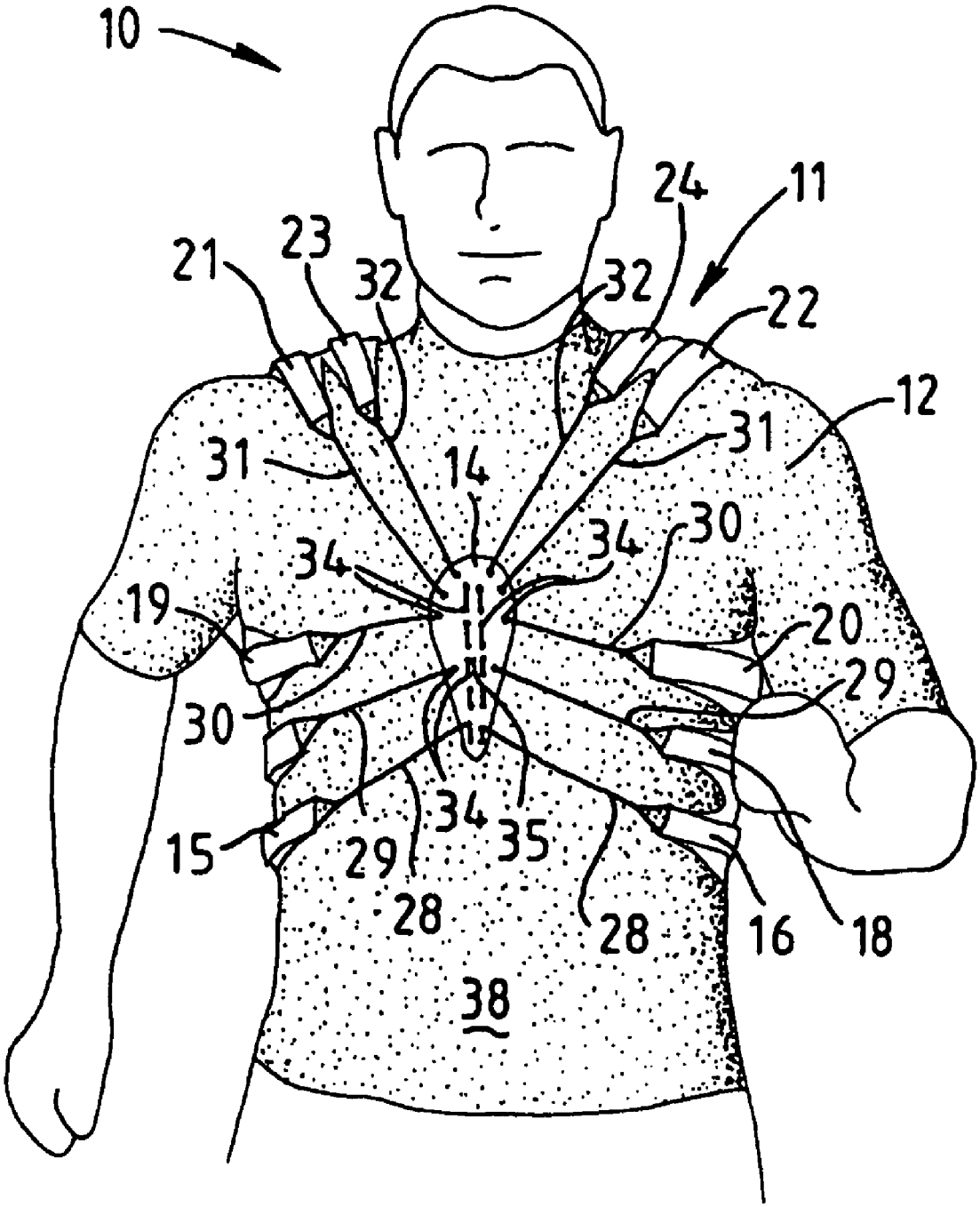
FIG. 2 shows a front view of the athlete of FIG. 1 wearing the training harness during the performance of aerobic exercise (running)

Referring simultaneously to FIGS. 1 and 2, there is shown an athlete generally indicated 10, wearing a first embodiment of training harness according to the present invention, generally indicated 11. The harness 11 fits snugly around the athlete's thorax 12 and is worn during the performance of aerobic exercise, as represented in FIG. 2 by the running posture of the athlete 10, so as to develop the athlete's inspiratory muscles.

The harness 11 comprises a back plate 13 and a substantially inflexible chest plate 14. Extending forwardly from the back plate 13 adjacent its base 26 is a first pair of side ribs 15, 16, one to each side of the athlete's thorax. Closely thereabove there extends a second pair of opposed ribs 17, 18, and then a third pair 19, 20 of side ribs. In addition, there are provided a first pair 21, 22 of shoulder ribs and also a second pair 23, 24—which extend from the back plate 13 adjacent its top 27. Each pair of opposed ribs comprises a right-hand member 15, 17, 19, 21, 23 and a left-hand member 16,18, 20, 22, 24.

As is shown best in FIG. 2, each of the ribs 15-24 is associated with a respective cord 28-32. Each right-hand rib 15, 17, 19, 21, 23 is interconnected with its left-hand counterpart 16, 18, 20, 22, 24 and cooperates therewith by virtue of their attachment to opposite ends of the same cord 28-32. To elaborate:

- the first pair of opposed side ribs 15, 16 are interconnected by a first cord 28;
- the second pair of opposed side ribs 17, 18 are interconnected by a second cord 29;
- the third pair of opposed side ribs 19, 20 are interconnected by a third cord 30;
- the first pair of opposed shoulder ribs 21, 22 are interconnected by a fourth cord 31; and
- the second pair of opposed shoulder ribs 23, 24 are interconnected by a fifth cord 32.

The cords 28-32 pass through apertures 34 around the perimeter of the chest plate 14, and are laced through further apertures 34 located in the centre of the chest plate 14, such that a central portion 35 of each of the cords 28-32 emerges through the front of the chest plate 14. By varying the emergent length 35 of each of the cords 28-32 the athlete can adjust the normal circumference of the training harness 11, and thereby vary the tension in the cord as it stretches between the respective associated resiliently flexible ribs 15-24. This in turn varies the resistance to expansion of the thorax 12 exerted by the training harness 11.

The adjustment of the training harness 11 described above can be achieved in any convenient manner, by either tightening up or loosening off the cords by withdrawing or releasing a greater or lesser length of emergent portion 35. At its simplest, one can either pull out a greater length of the emergent portion 35 of the cords 28-32 through the apertures 34 on the chest plate 14, or conversely slacken them off. However, in order to simplify the act of adjustment it is currently envisaged that the training harness 11 will include control means (not shown in FIGS. 1 and 2) located on the chest plate 14 including a reel for either winding in or winding out the respective cord. When provided with such a reel, it in turn will desirably be equipped with a dial for ease of setting by the athlete at some desired constrictive value. One possible construction of control means will be described subsequently with reference to FIG. 3.

As is best shown in FIG. 1, the ribs 15-24 are provided with webbing 36 therearound, in order both to provide enhanced comfort to the athlete 12, and also more evenly to spread the resistive load imparted to him by the training harness 11.

The webbing 36 will desirably be designed to mirror the construction of the musculature, and may conveniently extend between adjacent ribs, e.g. 15, 17 and 22, 24. To provide further support for the athlete 12, the training harness 11 is also here provided with struts 37 linking the third pair of side ribs 19, 20 with the first pair of shoulder ribs 21, 22.

The first embodiment of training harness 11, as described above, is designed to apply an elastic resistive load to the athlete's thorax 12 in order to exercise the athlete's inspiratory muscles. However, such an elastic resistance based system tends to assist the athlete's expiratory muscles when the elastic ribs 15-24 return to their unstretched state during expiration.

Figure 3:
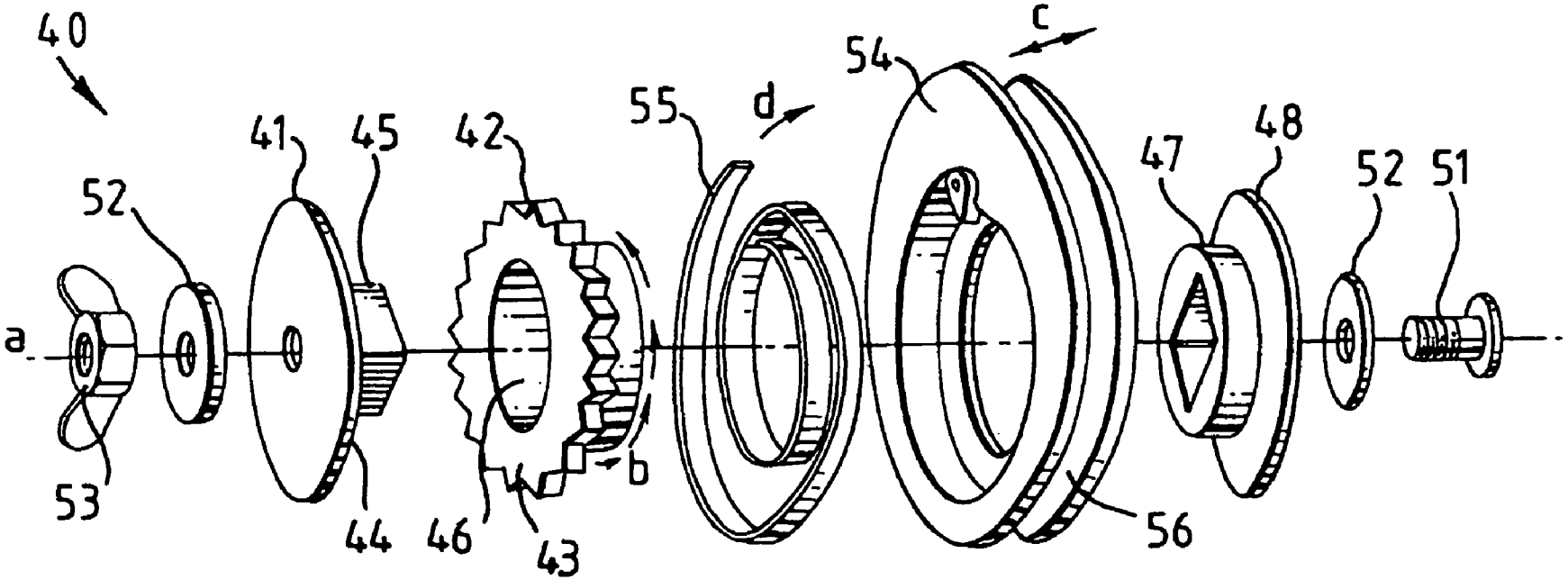
FIG. 3 shows an exploded view of control means for use in an alternative embodiment of the present invention.

Referring now to FIG. 3, there is shown an exploded view of control means, generally indicated 40, for use in an alternative embodiment of training harness 11 according to the present invention. In this embodiment, the athlete's inspiratory muscles are required to work against an applied frictional resistive load, rather than an elastic resistive load. In this way, the un-wanted assistance of the expiratory muscles is avoided.

The construction of the harness 11 of this frictional embodiment is essentially indentical to that illustrated in FIGS. 1 and 2, except that the ribs 15-24 are formed from substantially inelastic material. The chest plate 14 is also adapted to house the control means 40, which will now be described in detail with reference to FIG. 3.

The control means 40 comprises a fixed disc 41, and a friction disc 42 mounted co-axially therewith about a common axis a, and arranged such that an outer face 43 of the friction disc 42 bears against an inner face 44 of the fixed disc 41. The friction disc 42 is capable of rotation about the common axis a in one direction only, as indicated by arrows b.

The fixed disc 41 has an inwardly-directed flange 45 arranged to protrude through an annular cavity 46 provided in the friction disc 42 to engage with a complementary flange 47 on a base plate 48. The base plate 48 is adapted for fixing to the chest plate 14 of the training harness 11. The fixed disc 41 is secured to the base plate 48 by means of a bolt 51, washers 52, and a winged nut 53. The nut 53 can also be used to adjust the frictional force applied to the athlete 10, by tightening or loosening the engagement of the friction disc 42 with the fixed disc 41.

The control means 40 also comprises a cam pulley 54 and a return spring 55 associated therewith. The cam pulley 54 communicates with the friction disc 42 and likewise is held between the base plate 48 and the fixed disc 41. The cam pulley 54 is capable of rotation in either direction, as indicated by arrow c, however the spring 55 is biased to return the cam pulley 54 to an initial rest position following each rotation of the friction disc 42, as indicated by arrow d.

The cam pulley 54 is adapted to receive the inelastic cords 28-32 within a groove extending around its circumference.

Upon the athlete 10 inspiring, his inspiratory muscles are required to work to overcome the friction between the friction disc 42 and the fixed disc 41. This enables the cam pulley 54 and the friction disc 42 to rotate counter-clockwise, as indicated by arrow b, thus unwinding the cords 28-32 from the groove 56 and permitting expansion of the training harness 11. The elliptical shape of the cam pulley 54 ensures that the applied resistive load decreases as the athlete 10 inspires. Once inspiration is complete, the return spring 55 re-sets the cam pulley 54, by rotating it in a clockwise direction, as indicated by arrow d, thus winding in the cords 28-32, and hence causing contraction of the training harness 11 back to its initial condition, ready for the next inspiration. However, the friction disc 42 does not rotate in a clockwise direction, thus ensuring that the athlete's expiration is neither resisted nor assisted.

Referring again to FIGS. 1 and 2, the athlete 12 is shown wearing a garment 38, made from a so-called compression material, such as Lycra®, in order to spread the resistive load imparted by the training harness 11. In further alternative embodiments of the present invention (not illustrated), the garment 38 may be formed integrally with the training harness 11, or may itself be adapted to act as the training harness.

The invention claimed is:

1. A training harness for exercising an athlete's inspiratory muscles, said harness being adapted when in use during the performance of aerobic exercise to embrace the athlete's thorax, said harness comprising:

a chest plate, a back plate, and linkages comprising a plurality of ribs extending from each side of the back plate forwardly around each side of the athlete's thorax, to interconnect said plates, said linkages normally defining a pre-determined circumference of said harness, but permitting an increase in said circumference against an applied resistive load upon expansion of the athlete's thorax.

2. The training harness as claimed in claim 1, wherein each rib has a substantially-inextensible cord associated therewith, said cord passing through and emerging from an aperture in the chest plate.

3. The training harness as claimed in claim 2, wherein the ribs are arranged in opposed pairs, the respective members of the pair being arranged symmetrically on opposite sides of the athlete's thorax, and the distal ends of the opposed ribs in each pair are connected to opposite ends of the same cord.

4. The training harness as claimed in claim 3, further comprising at least one pair of opposed ribs adapted to embrace the athlete's shoulders.

5. The training harness as claimed in claim 3, comprising five pairs of opposed ribs.

6. The training harness as claimed in claim 2, further comprising control means including a reel device for winding-in and winding-out the cord, so as to vary the normal circumference of the harness, and thereby to vary the resistance against expansion of the athlete's thorax.

7. The training harness as claimed in claim 6, wherein the control means further comprises a dial, the rotation of which increases and decreases the length of the cord(s), and hence the resistive load imparted by the ribs.

8. The training harness as claimed in claim 6, wherein the control means further comprises a ratcheted drum including a quick release mechanism.

9. The training harness as claimed in claim 6, wherein the control means further comprises means for varying the applied resistive load during expansion of the athlete's thorax.

10. The training harness as claimed in claim 9, wherein the load varying means comprises a cam pulley adapted to decrease the applied resistive load during expansion of the athlete's thorax.

11. The training harness as claimed in claim 10, wherein the load varying means further comprises a return spring mechanism for re-setting the cam pulley following each expansion of the athlete's thorax.

12. The training harness as claimed in claim 1, wherein the applied resistive load is an elastic resistive load.

13. The training harness as claimed in claim 1, wherein the chest plate is relatively inflexible and the linkages are elastically-expandable.

14. The training harness as claimed in claim 1, wherein the applied resistive load is a frictional resistive load.

15. The training harness as claimed in claim 14, further comprising control means including a first fixed disc and a second rotatable disc in communication with one or more substantially-inextensible cords attached to the harness linkages, said first and second discs being mounted co-axially and arranged such that a face of said second disc bears against a face of said first disc, work being required by the athlete to overcome the frictional resistance between the two opposed disc faces.

16. The training harness as claimed in claim 15, wherein the second disc is capable of rotation in one direction only, such that no rotation thereof occurs upon contraction of the athlete's thorax.

17. The training harness as claimed in claim 14, wherein the harness linkages are substantially inelastic.

18. The training harness as claimed in claim 1, having a garment attached thereto, said garment formed from a compression material.

19. The training harness as claimed in claim 1, wherein the chest plate, the back plate and the side linkages are each constructed from a compression material.

20. The training harness as claimed in claim 19, wherein the chest plate, the back plate and the side linkages define a plurality of panels, each said panel being formed of a material selected to apply a pre-determined load to a corresponding area of the athlete's thorax, said load being calculated according to the degree of expansion of said thoracic area and the tensile properties of the material fibres.

* * * * *